US007230602B2

(12) United States Patent
Lin

(10) Patent No.: US 7,230,602 B2
(45) Date of Patent: Jun. 12, 2007

(54) SOURCE DRIVER AND STRUCTURE OF ADJUSTING VOLTAGE WITH SPEED

(75) Inventor: Che-Li Lin, Taipei (TW)

(73) Assignee: Novatek Microelectronics Corp., Hsinchu (TW)

( * ) Notice: Subject to any disclaimer, the term of this patent is extended or adjusted under 35 U.S.C. 154(b) by 137 days.

(21) Appl. No.: 11/161,851

(22) Filed: Aug. 19, 2005

(65) Prior Publication Data

US 2006/0244709 A1 Nov. 2, 2006

(30) Foreign Application Priority Data

Apr. 28, 2005 (TW) ..... 94113636 A

(51) Int. Cl.
*G09G 3/36* (2006.01)

(52) U.S. Cl. ..... 345/100; 345/98; 345/99

(58) Field of Classification Search ..... 345/98–100
See application file for complete search history.

(56) References Cited

U.S. PATENT DOCUMENTS 5,523,772 A * 6/1996 Lee ..... 345/98
2005/0088394 A1* 4/2005 Chung ..... 345/96
2005/0110738 A1* 5/2005 Kim et al. ..... 345/100
2006/0146000 A1* 7/2006 Choi ..... 345/100
2007/0018938 A1* 1/2007 Wei et al. ..... 345/100

* cited by examiner

*Primary Examiner*—Vibol Tan
(74) *Attorney, Agent, or Firm*—Jianq Chyun IP Office

(57) ABSTRACT

A source driver having a structure of adjusting voltage with speed is suitable for use in a panel displaying apparatus for driving a display array unit. The structure of adjusting voltage with speed has a logic speed monitoring unit, an internal logic voltage generator, a substrate voltage generator, a substrate leakage-current monitoring unit, and a power management control unit. In this manner, by monitoring the logic operation speed of an internal logic circuit in the source driver, in accordance with the change of the operation frequency, the power is dynamically adjusted, so as to optimize a condition between the power consumption and the operation speed. And, in the standby mode, the power consumption is further reduced by adjusting the substrate voltage. Also and, according to the substrate leakage current of the source driver, the substrate voltage can also be adjusted.

25 Claims, 5 Drawing Sheets

SOURCE DRIVER AND STRUCTURE OF ADJUSTING VOLTAGE WITH SPEED

CROSS-REFERENCE TO RELATED APPLICATION

This application claims the priority benefit of Taiwan application serial no. 94113636, filed on Apr. 28, 2005. All disclosure of the Taiwan application is incorporated herein by reference.

BACKGROUND OF THE INVENTION

1. Field of Invention

The present invention relates to a display driving technology of a panel display apparatus, more specifically, to a source driver of a panel display apparatus. This source driver can optimize the operation voltage with the operation speed.

2. Description of Related Art

Due to the great advancement and development in video display technology in recent a few years, a large portion of the conventional Cathode Ray Tube (CRT) has been substituted with the so-called panel display. The common panel display is thin-film transistor liquid crystal display (TFT-LCD). In addition, the LCD panel display or plasma panel display are becoming more and more popular.

The display portion of panel display includes pixel array which usually is determinant matrix. And the pixels are controlled by the driver. The corresponding pixels are driven according to the video data.

FIG. 1 illustrates a circuit block diagram of the source driver of conventional LCD display. LCD display drives pixels using a source driver and a gate driver. Color correction data will be input to the source driver to correct the color of display. As shown in the figure, the source driver usually includes a shift register, a line latch, a level shifter, a digital to analog converter (DAC), output buffer, a signal receiver and a data register. Wherein, the DAC receives Gamma voltage VGMA1-VBGMA14 of Gamma color connection curve which is input in parallel. Signal receiver receives input signals, for example receives signals corresponding to RSDS. In addition, the output buffer outputs several signals Y1, Y2, . . . to drive the display of pixels. Since the conventional source driver shown in FIG. 1 is a conventional technology which is known by those who are skilled in the field, therefore it is not described in detail herein.

And for source driver, the input of which can include Gamma voltage, data signal, control signal, carry in, analog voltage, digital voltage and clock, etc. As for output, it also includes a carry out. Since these input and output signals and source driver operation can be know by those who are generally skilled in the field, therefore it is not described in detail herein.

In addition, for the conventional panel display apparatus, for example TFT LCD, the voltage supplied to the logic system usually is 3.0V~3.6V, and 3.3V is relatively a common setting. In this situation, the logic core circuit of the source driver and the gate driver operates at 3.0V~3.6V or 3.3V. For the conventional source driver, all of the internal operation is at the same logic operation voltage which is the same as that of the system. When the system sets a logic voltage, the speed and power within the driver usually are not at an optimized value, and can not be adjusted dynamically. The speed within the driver for example refers to gate delay time reciprocal, and the power refers to the operation power provided to the logic circuit.

In addition, if the power consumption of the panel display is too large, for some of the portable electronic apparatus with panel display, the duration of the batteries may be reduced, and it is impossible to achieve an optimized operating speed.

SUMMARY OF THE INVENTION

One of the objects of the present invention is to provide a source driver, and by monitoring the logic operation speed of an internal logic circuit of the source driver, the power is dynamically adjusted to optimize the condition between the power consumption and the operation speed according to the change of the operation frequency. And, in the standby mode, the power consumption is reduced by adjusting the substrate voltage. And, the operation voltage is dynamically adjusted through monitoring the substrate leakage-current of source driver.

Another one of the objects of the present invention is to provide a voltage and speed adjusting structure which can operate in conjunction with a source driver circuit to achieve an optimized condition between power and speed.

Another one of the objects of the present invention is to provide a panel display apparatus, wherein the source driver can include the voltage and speed adjusting structure of the present invention to achieve an optimized condition between the power and the speed.

The present invention provides a source driver suitable for use in a panel display apparatus. This source driver drives a display array unit according to a plurality of input signals. The source driver includes a driver circuit, a logic control circuit, an input level shifter, a logic speed monitoring unit, an internal logic voltage generator, a substrate voltage generator, a substrate leakage-current monitoring unit and a power management control unit.

Wherein, the driver circuit receives a portion of the input signals to drive the display array unit. The logic control circuit is coupled with the driver circuit and a control signal is generated to control the driver circuit. The input level shifter receives a system input signal to convert an input level of the system input signal into a logic level to input to logic control circuit. The internal logic voltage generator receives a substrate voltage generated by the substrate voltage generator and an external logic voltage, and receives a control signal of the power management control unit to generate an internal logic voltage for the logic control circuit, the input level shifter and the logic speed monitoring unit. The logic speed monitoring unit feeds back a logic speed signal to the power management control unit. The substrate voltage generator receives an external logic voltage and a control signal of the power management control unit to generate the substrate voltage for at least one of the logic control unit, the input level shifter and the internal logic voltage generator. The substrate leakage-current monitoring unit feeds back a feedback signal to the power management control unit according to the strength of a substrate leakage current of the source driver. The power management control unit receives the feedback signal of the logic speed monitoring unit, the feedback signal of the substrate leakage-current monitoring unit, and an external control or the control signal of the internal logic voltage generator, to generate the control signal of the substrate voltage generator, and the control signal of the internal logic voltage generator.

The present invention provides a voltage and speed adjusting structure suitable for use in a source driver of a panel display apparatus to drive a display array unit. The adjusting structure includes a logic speed monitoring unit, an internal logic voltage generator, a substrate voltage generator, a substrate leakage-current monitoring unit and a power management control unit.

The logic speed monitoring unit feeds back a logic speed signal to the power management control unit. The internal logic voltage generator receives an external logic voltage and the substrate voltage generated by the substrate voltage generator, and receives a control signal of the power management control unit, so as to generate an internal logic voltage to be used by a logic portion of the source driver and the logic speed monitoring unit. The substrate voltage generator receives the external logic voltage and a control signal of the power management control unit to generate the substrate voltage to be used by the logic portion of the source driver. The substrate leakage-current monitoring unit feeds back a feedback signal to the power management control unit according to the strength of a substrate leakage-current of the source driver. The power management control unit receives the feedback signal of the logic speed monitoring unit and an external control signal or the control signal of the internal logic voltage generator to generate the control signal of the substrate voltage generator and the control signal of the internal logic voltage generator.

The present invention provides a panel display apparatus which includes a source driver circuit to drive a display array unit, and the voltage and speed adjusting structure as described previously, and the voltage and speed adjusting structure is coupled to the source driver circuit. The source driver circuit is controlled through dynamically adjusting an operation voltage and an operation speed.

The present invention further provides a source driver including a source driving unit, and further including an internal logic circuit, a logic speed monitoring unit and a an internal logic voltage generator. The source driving unit is used to receive that including a plurality of control input signals to output a plurality of video driving signals. A power management control unit receives those including a logic operation speed feedback signal of the logic speed monitoring unit to output a power control signal to the an internal logic voltage generator. Then, a logic operation voltage is further generated to dynamically adjust an operation speed of the internal logic circuit.

The present invention further provides a source driver including: a source driving unit which receives those including a plurality of video control input signals to output a plurality of video driving signals; a substrate leakage-current monitoring unit which is coupled to the source driving unit to monitor a substrate leakage-current; a power management control unit which receives a portion of the video control input signals, a portion of the video driving signals, an output signal of the substrate leakage-current monitoring unit, and a power sleep/shut-down mode signal, so as to output a plurality of power control signals; a substrate voltage generator which is coupled to the source driving unit and the power management control unit. The power control signals output by the power management control unit control the source driving unit and the substrate voltage generator respectively to generate a plurality of voltage control signals used to dynamically adjust the operation voltage of the source driving unit.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE PREFERRED EMBODIMENTS

The present invention at least is for reducing the power consumption of panel display apparatus, for example TFT LCD display, so that an optimized condition between the power and performance is pursued. While the system still provides a general logic voltage, say 3.0V~3.5V, an optimal performance still can be achieved through the internal voltage regulation of the driver.

The mechanism of the present invention is to utilize the proportional relation between the power and the value of $C \times V2 \times f$. With an operation frequency f, an optimal performance can be achieved by adjusting the voltage appropriately. And, in the standby/sleeping mode, the present invention also has a better energy saving efficiency. The present invention can match the variable supply voltage and the variable threshold voltage, and can realize the self-adjustment and the self-optimization function in conjunction with the controlled function block. In this way, an optimized balance between speed and power can be achieved.

In addition, the substrate leakage-current can also be monitored, therefore even though there is a difference caused by operation temperature and process deviation, the dynamic regulation of optimization can still be achieved.

While the characteristic of the present invention will be described in the follow with reference to an embodiment, however the present invention is not limited by the description of the embodiment.

Figure 1:
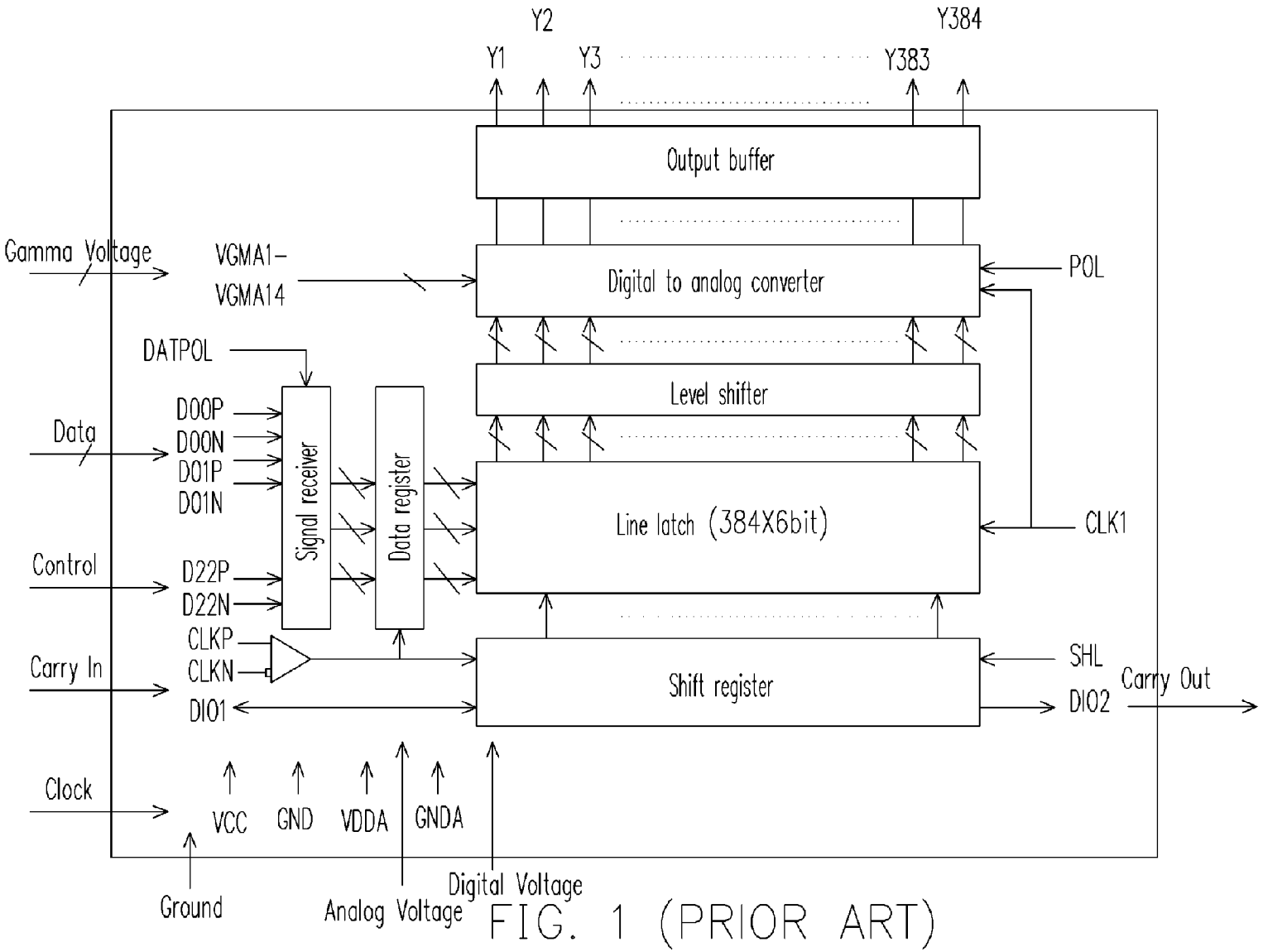
FIG. 1 (PRIOR ART)
FIG. 1 schematically illustrates a circuit block diagram of the source driver of conventional LCD display.
Figure 2:
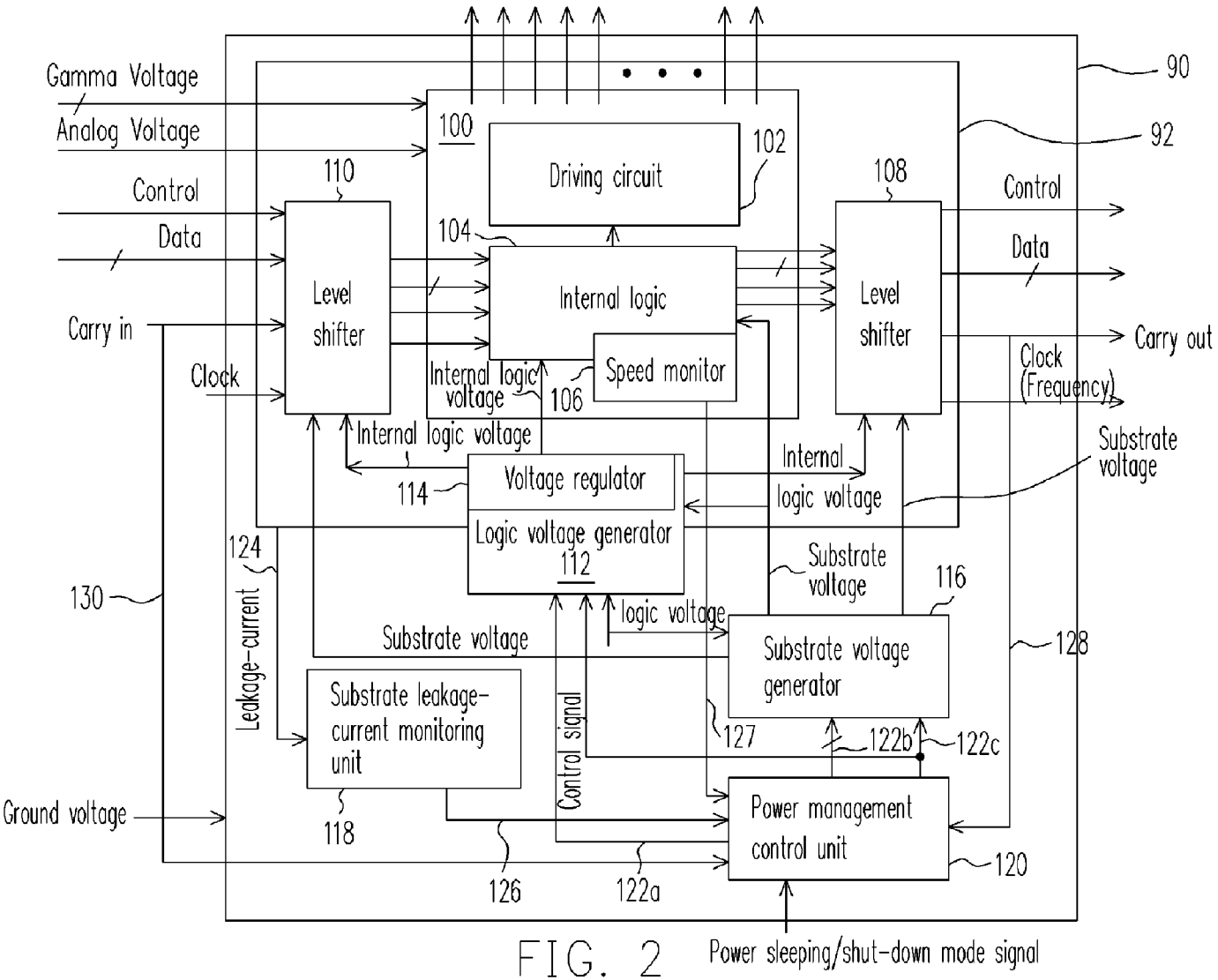
FIG. 2 schematically illustrates a circuit block diagram of the source driver according to the embodiment of the present invention.

FIG. 2 schematically illustrates a circuit block diagram of the source driver according to the embodiment of the present invention. In FIG. 2, the source driver 90 includes a source driving unit 92, a substrate voltage generator 116, a substrate leakage-current monitoring unit 118, and a power management control unit 120.

The operation for the source driver 90 of the present invention, for example the source driving unit 92, is used to receive those including a plurality of video control input signals, such as including Gamma voltage signal, control signal, video data, carry in and clock, etc . . . , so as to output a plurality of video driving signals, for example including driving signals for driving the pixel array (not shown), and the data signals, a clock and a carry out 128, etc.

The substrate leakage-current monitoring unit 118 is coupled to the source driving unit 92 to monitor a substrate leakage-current 124 of the source driving unit 92. The power management control unit 120 receives a portion of the video control input signals, for example the carry in 130, and a portion of the video driving signals, for example the carry out 128. The substrate leakage-current monitoring unit 118 can also be coupled with the substrate voltage generator 116 and the source driving unit 92. Wherein, the substrate leakage-current monitoring unit 118 outputs a signal 126 corresponding to the substrate leakage-current to the power management control unit 120. And, the power management control unit 120 also receives a power sleeping/shut-down mode signal to determine the current operation state, thus to output a plurality of power control signals 122*a,* for example including signals 122*a,* 122*b,* 122*c.*

The substrate voltage generator 116 is coupled to the source driving unit 92 and the power management control unit 120. Wherein, the power control signals 122*a,* 122*b* and 122*c* output by the power management control unit 120 can control the source driving unit 92 and the substrate voltage generator 116, to generate a plurality of voltage control signals used to dynamically adjust the logic circuit operation voltage of the source driving unit 92, so as to adjust the internal logic operation speed.

For the further design, the source driving unit 92 for example can include a driving portion 100, an input level shifter 110, an output level shifter 108 and a logic voltage generator 112. And, the driving portion 100 can include a driving circuit 102, for example the conventional source driver, an internal logic circuit 104 and a speed monitor 106.

The input level shifter 110 is used to receive for example the control signals, the data signals, the carry in 130 and the clock. The output level shifter 108 outputs the previously described video driving signals. In addition, the internal logic circuit 104 executes the internal logic calculation and control of the source driver. The speed monitor 106 monitors the gate delay on the operation path of the internal logic circuit 104, especially on the path of a critical logic circuit therein. While the gate delay can not reach a specific value under a specific frequency, it will transmit a gate delay feedback signal 127 to the power management control unit 120. At this moment, the power management control unit 120 controls the logic voltage generator 112 through the signal 122*c,* for example, to increase the internal voltage so as to increase the internal logic operation speed.

And, when the gate delay is far smaller than the specified value under a specific frequency, a gate lead feedback signal 127 is transmitted to the power management control unit 120 and therefore to control the logic voltage generator 112, for example to reduce the internal logic voltage to moderate the internal logic operation speed. At this moment, since the logic voltage is reduced, the power consumption can be reduced. Through the above two exemplary mechanisms or other similar mechanisms, an optimal balance between the operation speed and operation power of the source driver of, for example TFT LCD, can be achieved.

And, to further reduce the power consumption, when the adjustment of the internal logic operation is complete by the source driver, the source driver sends out the carry out 128 which will be fed back to the power management control unit 120. The power management control unit 120 for example is in standby mode which is determined by the carry out 128 or the power sleeping/shut-down signal. And the power management control unit 120 also outputs the signal 122*b* to the substrate voltage generator 116, for example, so that the substrate voltage of the n-well can be increased, and therefore the substrate voltage of the p-well can be reduced as well. Thus, the absolute value of the threshold voltage corresponding to PMOS (P-type metal oxide semiconductor (MOS)) component or NMOS (N-type MOS) component can be increased to a value which is above the normal operation value, whereby the power loss caused by the leakage-current can be reduced.

In addition, when the power management control unit 120 is in standby mode, the logic voltage generator 112 will be informed to reduce the logic operation voltage through the internal regulator 114. Thus, through controlling the logic voltage generator 112 and the substrate voltage generator 116, the goal of saving energy in standby mode is reached by the power management control unit 120.

And, when the source driver 90 receives the carry in 130, the power management control unit 120 then activates the logic voltage generator 112 and the substrate voltage generator 116 to return to the original logic operation voltage. At this moment, the substrate voltage generator 116 returns to the substrate voltage of normal operation, and according to the original logic operation voltage, the power consumption and operation speed thereof can be returned to an optimized condition which was originally achieved.

And, the source driver of the present invention may further include the substrate leakage-current monitor 118 to monitor the status of substrate leakage-current of source driver 90. The detected results can be transmitted to the power management control unit 120. And the substrate voltage generator 116 can be dynamically adjusted by the power management control unit 120, whereby the substrate voltage can also be adjusted dynamically according to the level of the leakage-current so as to achieve the optimized operation condition.

Therefore, as the source driver 90 shown in FIG. 2, at least an optimized balance condition between the power consumption, operation speed, operation temperature and the operation mode can be achieved by the present invention.

An embodiment is used to describe the circuit design of individual circuit block in FIG. 2.

Figure 3:
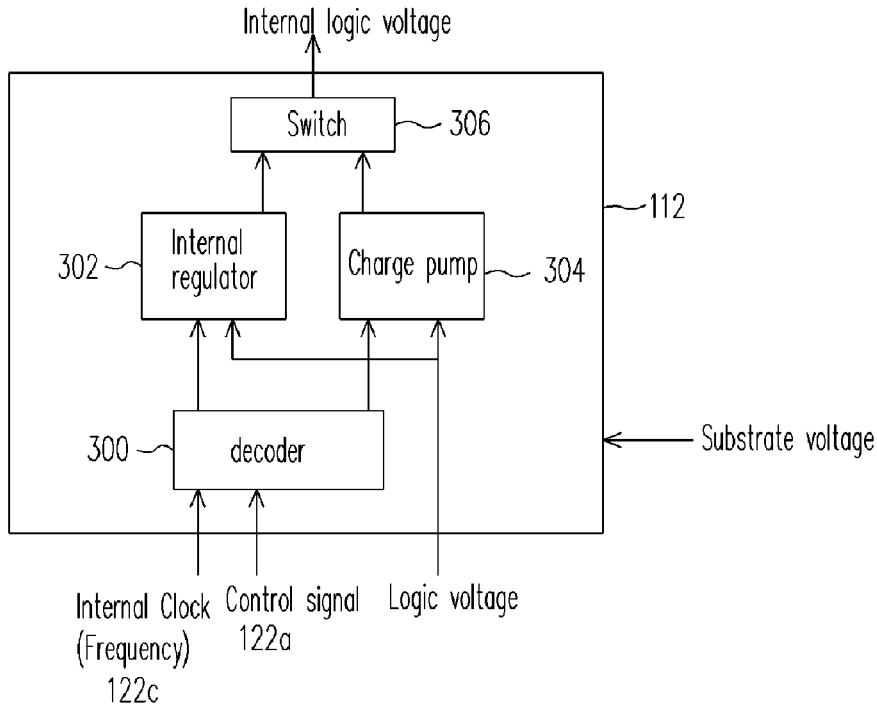
FIG. 3 schematically illustrates a circuit block diagram of the logic voltage generator according to the embodiment of the present invention.

FIG. 3 schematically illustrates a circuit block diagram of the logic voltage generator according to the embodiment of the present invention. In design, the logic voltage generator 112 for example can include a decoder 300, an internal regulator 302, a charge pump 304 and a switch 306. The decoder 300 receives the internal frequency signals and control signals to decode out the required output signals, and respectively input to the internal regulator 302 and the charge pump 304 respectively. In addition, the logic voltage of input also is input to the internal regulator 302 and the charge pump 304 at the same time. The voltage is then adjusted by the internal regulator 302 and the charge pump 304, and then the internal logic voltage is output through the selection of switch 306.

Figure 4:
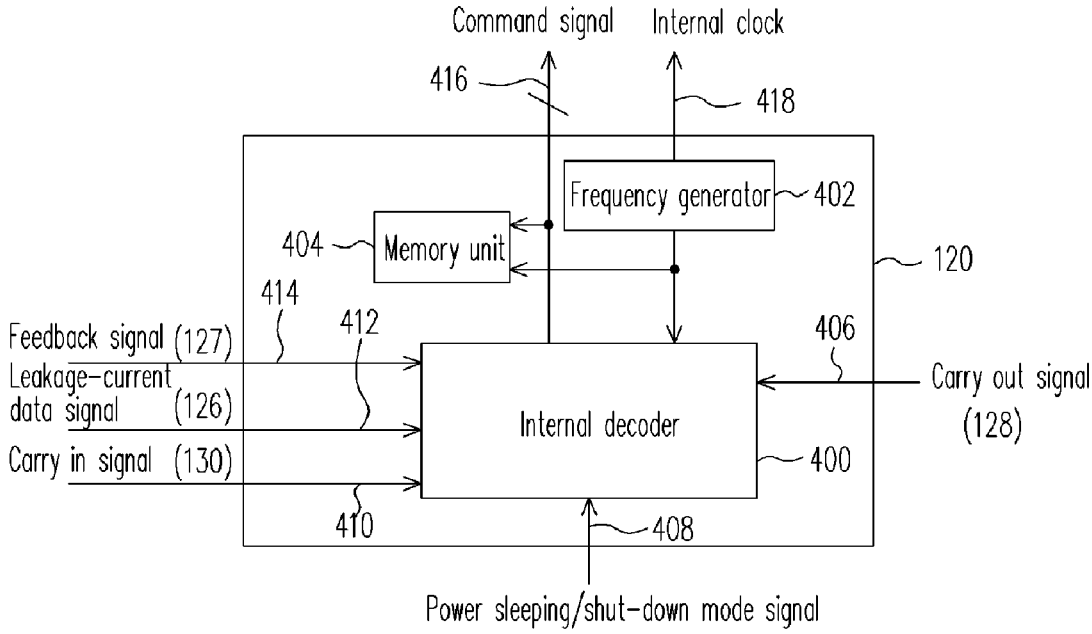
FIG. 4 schematically illustrates a circuit block diagram of the power management control unit according to the embodiment of the present invention.

FIG. 4 schematically illustrates a circuit block diagram of the power management control unit according to the embodiment of the present invention. In FIG. 4, the power management control unit 120 includes an internal decoder 400, a memory unit 404 and a frequency generator 402, wherein the memory unit 404 for example can be a register. The internal decoder 400 of the power management control unit 120 receives the feedback signal 127, the leakage-current signal 126, the carry in 130, the power sleeping/shut-down mode signal 408 and the carry out 128. In addition, the frequency generator 402 generates frequency signals for the internal decoder 400 to decode out the command signal 416. In addition, the command signal 416 is also stored in the memory unit 404 which is for example a register controlled by frequency. In addition, the frequency generator 402 also outputs the internal frequency 418.

Figure 5:
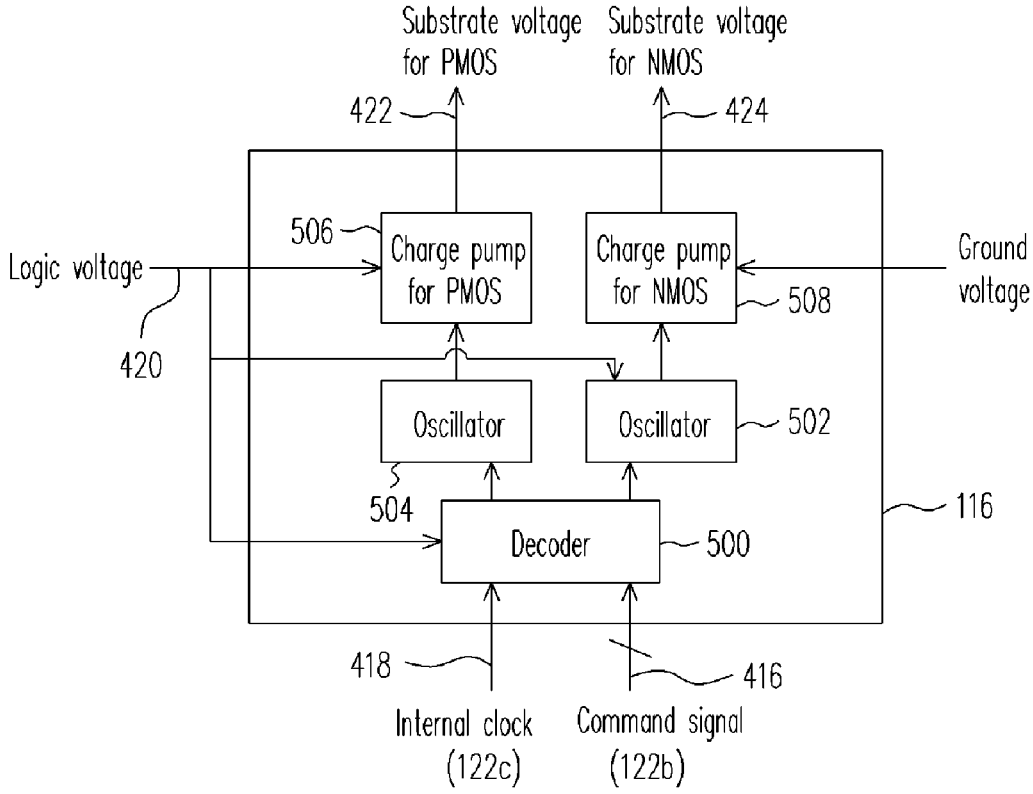
FIG. 5 schematically illustrates a circuit block diagram of the substrate voltage generator according to the embodiment of the present invention.

FIG. 5 schematically illustrates a circuit block diagram of the substrate voltage generator according to the embodiment of the present invention. In FIG. 5, the substrate voltage generator 116 includes a decoder 500, oscillators 502, 504, a charge pump 506 for PMOS, a charge pump 508 for NMOS. The oscillators 502, 504 for example are ring oscillators. The decoder 500 receives internal frequency signal 418 (122*c*) and command signal 416 (122*b*) output by power management control unit 120. In addition, the logic voltage 420 is also input to the decoder 500, the oscillators 502, 504 and the charge pump 506 for PMOS. And the charge pump 508 for NMOS receives a ground voltage. Here, since the operation voltages of PMOS and NMOS components are different, they are provided respectively by the charge pump 506 and the charge pump 508. In addition, the required frequency can also be provided by the internal frequency signal output by the power management control unit 120. Lastly, the charge pump 506 and the charge pump 508 output the substrate voltage 422 of PMOS and the substrate voltage 424 of NMOS, respectively.

Figure 6:
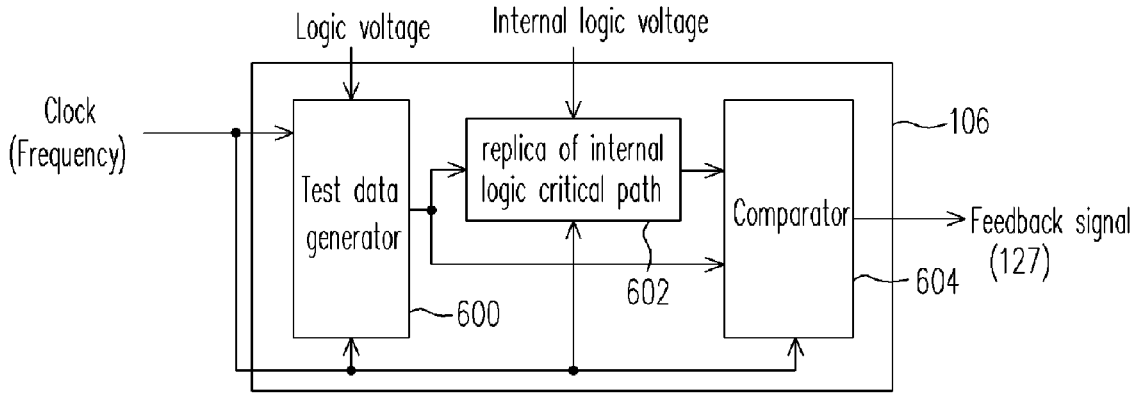
FIG. 6 schematically illustrates a circuit block diagram of the speed monitor according to the embodiment of the present invention.

FIG. 6 schematically illustrates a circuit block diagram of the speed monitor according to the embodiment of the present invention. The speed monitor 106 for example includes a test data generator 600, a critical path replica of the internal logic 602, a comparator 604. The speed monitor 106 receives the frequency signals and transmits them to the circuit blocks. In addition, the test data generator 600, for example a pattern generator, also receives a logic voltage to generate two test data, one is input to comparator 604 directly, and the other is input to the critical path replica of internal logic 602 and then input to the comparator 604. Since the critical path replica of internal logic 602 is the critical path of the replica logic circuit, it can reflect the operation speed. Therefore, a phase delay occurs after the test data pass through the block 602. The comparator 604 compares the differences between the phase delays of these two test data, and generates a feedback signal 127 to the power management control unit 120, so as to dynamically adjust the logic operation voltage.

Figure 7:
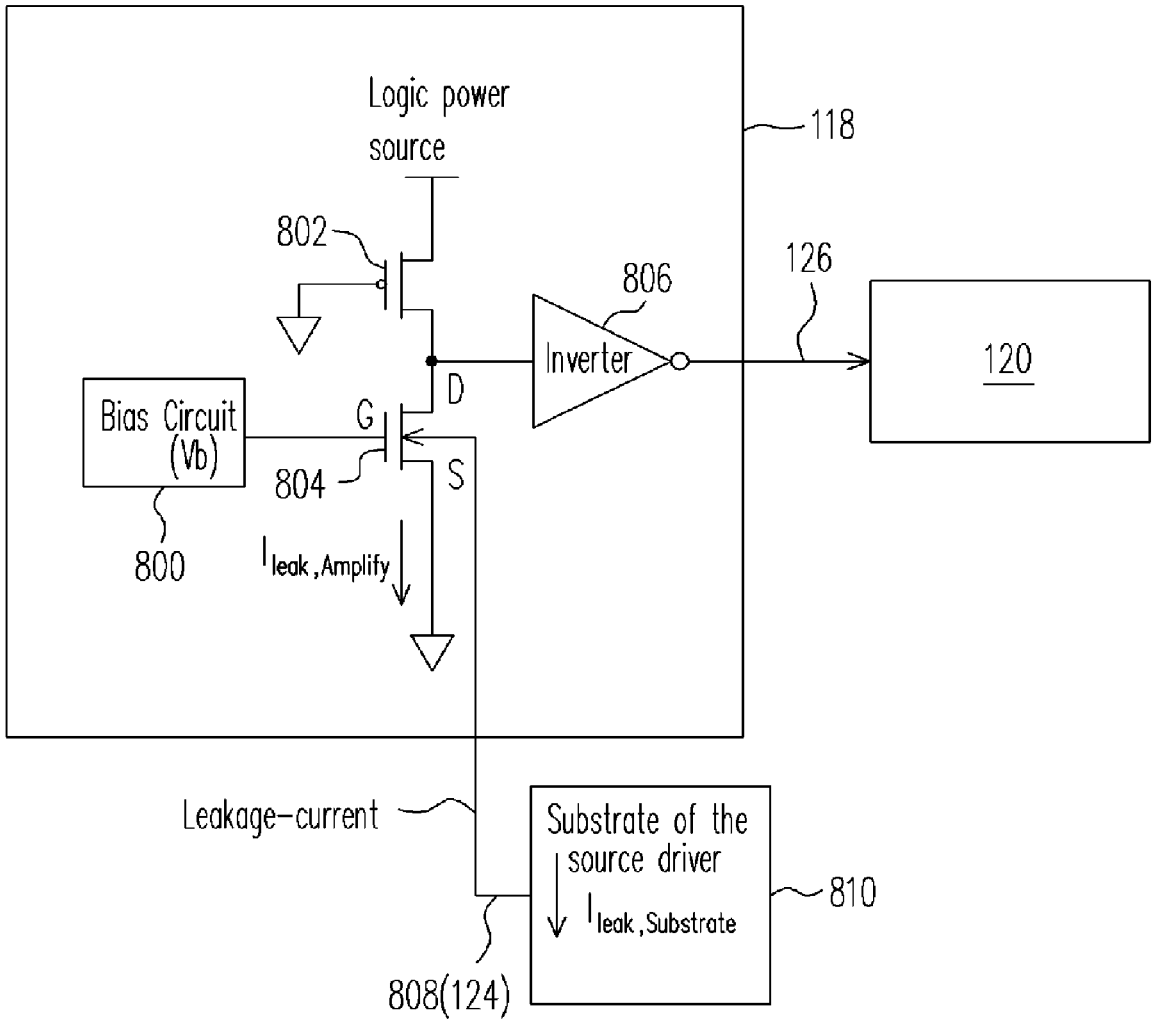
FIG. 7 schematically illustrates a circuit block diagram of the substrate leakage-current monitoring unit according to the embodiment of the present invention.

FIG. 7 schematically illustrates a circuit block diagram of the substrate leakage-current monitoring unit according to the embodiment of the present invention. The substrate leakage-current monitoring unit 118 for example includes a PMOS transistor 802 and a NMOS transistor 804 which are connected in series between the logic power source and the ground voltage. And the connection terminal, i.e. the source terminal D of the NMOS transistor 804 is connected to an inverter 806. Inverter 806 outputs signal 126 to the power management control unit 120. And the gate of transistor 802 is connected to ground voltage. The gate terminal G of transistor 804 is connected to a bias circuit 800 to generate a voltage Vb. The source terminal S of transistor 804 is also connected to ground voltage. The substrate of transistor 804 is connected to the substrate 810 of a source driver, and there is a substrate leakage-current Ileak,substrate 808. When a voltage is applied to transistor 804 by the voltage circuit 800, if the amplified leakage-current Ileak, amplify is greater than the substrate voltage designed by the substrate voltage generator 116, the value corresponding to the threshold voltage of transistor 804 and the bias circuit 800 becomes a low level on drain terminal D, and it is then inversed by inverter 806 to become a high level and is output to the power management control unit 120. At this moment, the power management control unit 120 may further decode and transmit commands to substrate voltage generator 116 to regulate the substrate voltage. As thus, the substrate leakage-current Ileak, substrate 808 will be decreased. And the amplified leakage-current Ileak, amplify returns to the current value which is less than the designed current, and terminal D then becomes a high level, and then becomes a low level after being inverted by inverter 806. Therefore, the power management control unit 120 then stops informing the substrate voltage generator 116, and no longer keeps on regulating substrate voltage.

To sum up, at least by monitoring the logic operation speed of an internal logic circuit of source driver, the present invention dynamically adjusts the power in accordance to the change of the operation frequency, so that the power consumption and the speed are under an optimized condition. And in standby mode, the power consumption is reduced by adjusting substrate voltage. And, the operation voltage is adjusted through monitoring the substrate leakage-current of the source driver.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A source driver, suitable for use in a panel display apparatus to drive a display array unit according to a plurality of input signals, the source driver comprising:

a driving circuit, a logic control circuit, an input level shifter, a logic speed monitoring unit, an internal logic voltage generator, a substrate voltage generator, a substrate leakage-current monitoring unit and a power management control unit, wherein the driving circuit receives a portion of these input signals to drive the display array unit;

the logic control circuit coupled with the driving circuit generates a control signal to control the driving circuit;

the input level shifter receives a system input signal to transform an input level of the system input signal into a logic level to input to the logic control circuit;

the internal logic voltage generator receives a substrate voltage generated by the substrate voltage generator and an external logic voltage, and receives a control signal of the power management control unit to generate an internal logic voltage to the logic control circuit, the input level shifter and the logic speed monitoring unit;

the logic speed monitoring unit feeds back a logic speed signal to the power management control unit;

the substrate voltage generator receives an external logic voltage and a control signal of the power management control unit to generate the substrate voltage to at least one of the logic control circuit, the input level shifter and the internal logic voltage generator;

the substrate leakage-current monitoring unit feeds back a feedback signal to the power management control unit according to a quantity of a substrate leakage-current of the source driver; and the power management control unit receives the feedback signal of the logic speed monitoring unit, the feedback signal of the substrate leakage-current monitoring unit and an external control signal or the control signal of the internal logic voltage generator to generate the control signal of the substrate voltage generator and the control signal of the internal logic voltage generator.

2. The source driver of claim 1, wherein the source driver further comprises an output level shifter which receives an output signal of the logic control circuit, so as to convert the output signal into an output control signal, wherein the output control signal is also fed back to the power management control unit.

3. The source driver of claim 1, wherein the source driver is connected in serial or in parallel.

4. The source driver of claim 1, wherein the logic speed monitoring unit and the logic control circuit are integrated into a logic circuit block.

5. The source driver of claim 1, wherein the internal logic voltage generator comprises:

a decoder, receiving the control signal of the power management control unit to decode so as to acquire an internal control signal of the internal logic voltage generator;

a voltage regulator, receiving the internal control signal of the decoder and receiving a logic voltage and a substrate voltage to generate a post regulation voltage;

a charge pump, receiving the internal control signal of the decoder and receiving a logic voltage and a substrate voltage to generate a regulated voltage; and an analog switch, receiving the internal control signal of the decoder, the post regulation voltage and the regulated voltage to generate the internal logic voltage.

6. The source driver of claim 1, wherein the power management control unit comprises:

a decoder, receiving the logic speed signal fed back by the logic speed monitoring unit, receiving the feedback signal of the substrate leakage-current monitoring unit, and the external control signal or a control signal of the internal logic voltage generator to generate a control signal serving as the control signal of the substrate voltage generator and the control signal of the internal logic voltage generator;

a memory unit, receiving the control signal having been decoded by the decoder to store a system state;

a frequency generating unit, providing a frequency to the decoder and the memory unit.

7. The source driver of claim 6, wherein the frequency generating unit also provides the frequency to the substrate voltage generator and the internal logic voltage generator.

8. The source driver of claim 1, wherein the substrate voltage generator comprises:

a decoder, a first charge pump, a second charge pump and a oscillator unit, wherein the decoder receives the control signal and the frequency of the power management control unit so as to acquire an internal control signal of the substrate voltage generator through decoding, and receives the external logic voltage;

the first charge pump receives the internal control signal of the decoder, the external logic voltage, a frequency generated by the oscillator unit, to generate a PMOS substrate voltage for a PMOS component;

the second charge pump receives the internal control signal of the decoder, the external logic voltage, a frequency generated by the oscillator unit to generate a NMOS substrate voltage for a NMOS component; and the oscillator unit receives the logic voltage to generate the frequencies to the charge pumps.

9. The source driver of claim 1, wherein the substrate voltage generator comprises:

a decoder, a first charge pump and a second charge pump, wherein the decoder receives the control signal and the frequency of the power management control unit so as to acquire an internal control signal of the substrate voltage generator through decoding, and receives the external logic voltage;

the first charge pump receives the internal control signal of the decoder, the external logic voltage and the frequency so as to generate a PMOS substrate voltage for a PMOS component; and the second charge pump receives the internal control signal of the decoder, the external logic voltage and the frequency so as to generate a NMOS substrate voltage for a NMOS component.

10. The source driver of claim 1, wherein the logic speed monitoring unit comprises:

a test data generator, receiving the external logic voltage and a frequency of the logic control circuit to generate a first logic data;

a replica circuit, replicating a critical circuit in the logic control circuit, receiving the logic data generated by the test data generator, receiving the frequency of the logic control circuit, receiving the logic voltage generated by the internal logic voltage generator to generate a second logic data; and a comparator, receiving the first logic data and the second logic data to determine a data delay signal by comparison, so as to generate the logic speed signal to feed back to the power management control unit.

11. The source driver of claim 10, wherein the test data generator comprises a pattern generator.

12. The source driver of claim 1, wherein the substrate leakage-current monitoring unit comprises:

a bias circuit, receiving the external logic voltage to generate a NMOS gate voltage;

a NMOS component, comprising a gate terminal being applied the NMOS gate voltage, a source grounding, a drain terminal, a substrate connected to a substrate of the source driver;

a PMOS component, comprising a gate terminal connected to a logic low voltage, a source terminal connected to a logic high voltage, a drain terminal connected to the drain terminal of the NMOS component, a substrate connected to the logic high voltage; and an inverter, comprising an input (terminal) connected to the NMOS component and the drain terminal of the PMOS component, an output terminal to output the feedback signals to the power management control unit.

13. The source driver of claim 1, wherein the driving circuit, the logic control circuit, the input level shifter, the logic speed monitoring unit, the internal logic voltage generator, the substrate voltage generator, the substrate leakage-current monitoring unit and the power management control unit are integrated into one unit or a plurality of units.

14. A voltage and speed regulating structure, suitable for use in a source driver of a panel display apparatus to drive a display array unit, the regulating structure comprises:

a logic speed monitoring unit, an internal logic voltage generator, a substrate voltage generator, substrate leakage-current monitoring unit and a power management control unit, wherein the logic speed monitoring unit feeds back a logic speed signal to the power management control unit;

the internal logic voltage generator receives an external logic voltage and a substrate voltage generated by the substrate voltage generator, and receives a control signal of the power management control unit to generate an internal logic voltage for the use of a logic portion of the source driver and for the use of the logic speed monitoring unit;

the substrate voltage generator receives the external logic voltage and a control signal of the power management control unit to generate the substrate voltage for the use of the logic portion of the source driver;

the substrate leakage-current monitoring unit feeds back a feedback signal to the power management control unit according to the strength of a substrate leakage-current of the source driver; and the power management control unit receives the feedback signal of the logic speed monitoring unit, the feedback signal of the substrate leakage-current monitoring unit and an external control signal or the control signal of the internal logic voltage generator to generate the control signal of the substrate voltage generator and the control signal of the internal logic voltage generator.

15. The voltage and speed regulating structure of claim 14, wherein the internal logic voltage generator comprises:

a decoder, receiving the control signal of the power management control unit to decode so as to acquire an internal control signal of the internal logic voltage generator;

a voltage regulator, receiving the internal control signal of the decoder and receiving a logic voltage and a substrate voltage to generate a post regulation voltage;

a charge pump, receiving the internal control signal of the decoder and receiving a logic voltage and a substrate voltage to generate a regulated voltage; and an analog switch, receiving the internal control signal of the decoder, the post regulation voltage and the adjusted voltage to generate the internal logic voltage.

16. The voltage and speed regulating structure of claim 14, wherein the power management control unit comprises:

a decoder, receiving the logic speed signal fed back by the logic speed monitoring unit, receiving the feedback signal of the substrate leakage-current monitoring unit, and the external control signal or a control signal of the internal logic voltage generator to generate a control signal serving as the control signal of the substrate voltage generator and the control signal of the internal logic voltage generator;

a memory unit, receiving the control signal having been decoded by the decoder to store a system state;

a frequency generating unit, providing a frequency to the decoder, the memory unit and/or also provides the frequency to the substrate voltage generator and the internal logic voltage generator.

17. The voltage and speed regulating structure of claim 14, wherein the substrate voltage generator comprises:

a decoder, a first charge pump, a second charge pump and a oscillator unit, wherein the decoder receives the control signal and the frequency of the power management control unit, so as to acquire an internal control signal of the substrate voltage generator through decoding, and receives the external logic voltage;

the first charge pump receives the internal control signal of the decoder, the external logic voltage, a frequency generated by the oscillator unit to generate a PMOS substrate voltage for a PMOS component; and the second charge pump receives the internal control signal of the decoder, the external logic voltage, a frequency generated by the oscillator to generate a NMOS substrate voltage for a NMOS component; and the oscillator receives the logic voltage to generate the frequencies to the charge pumps.

18. The voltage and speed regulating structure of claim 14, wherein the substrate voltage generator comprises:

a decoder, a first charge pump, a second charge pump, wherein the decoder receives the control signal and the frequency of the power management control unit, so as to acquire an internal control signal of the substrate voltage generator through decoding, and receives the external logic voltage;

the first charge pump receives the internal control signal of the decoder, the external logic voltage and the frequency to generate a PMOS substrate voltage for a PMOS component; and a second charge pump receives the internal control signal of the decoder, the external logic voltage and the frequency to generate a NMOS substrate voltage for a NMOS component.

19. The voltage and speed regulating structure of claim 14, wherein the logic speed monitoring unit comprises:

a test data generator, receiving the external logic voltage and a frequency of the logic control circuit to generate a first logic data;

a replica circuit, replicating a critical circuit in the logic control circuit, receiving the logic data generated by the test data generator, receiving the frequency of the logic control circuit, receiving the logic voltage generated by the internal logic voltage generator to generate a second logic data; and a comparator, receiving the first logic data and the second logic data to determine a data delay signal by comparison, so as to generate the logic speed signal to feed back to the power management control unit.

20. The voltage and speed regulating structure of claim 14, wherein substrate leakage-current monitoring unit comprises:

a bias circuit, receiving the external logic voltage to generate a NMOS gate voltage;

a NMOS component, comprising a gate terminal being applied the NMOS gate voltage, a source grounding, a drain terminal, a substrate connected to a substrate of the source driver;

a PMOS component, comprising a gate terminal connected to a logic low voltage, a source terminal connected to a logic high voltage, a drain terminal connected to the drain terminal of the NMOS component, a substrate connected to the logic high voltage; and an inverter, comprising an input terminal connected to the NMOS component and the drain terminal of the PMOS component, an output terminal to output the feedback signal to the power management control unit.

21. A source driver comprising:

a source driving unit, comprising an internal logic circuit, a logic speed monitoring unit and an internal logic voltage generator, wherein the source driving unit is used to receive at least signals comprising a plurality of video control input signals so as to output plurality of video driving signals; and a power management control unit, receiving at least a signal comprising a logic operation speed feedback signal of the logic speed monitoring unit, so as to output a power control signal to the internal logic voltage generator, and further generating a logic operation voltage to dynamically regulate an operation speed of the internal logic circuit.

22. The source driver of claim 21, wherein the logic speed monitoring unit monitors an operation speed of at least a critical path of the internal logic circuit, to output the logic operation speed feedback signal.

23. A source driver comprising:

a source driving unit, used to receive those comprising a plurality of video control input signals, so as to output a plurality of video driving signals;

a power management control unit, receiving a portion of the video control input signals, a portion of the video driving signals, an output signal of the substrate leakage-current monitoring unit, and a power sleeping/shutdown mode signal, thus to output a plurality of power control signals; and a substrate voltage generator, coupled with the source driving unit and the power management control unit, wherein the power control signals output by the power management control unit control the source driving unit and the substrate voltage generator respectively, so as to generate a plurality of voltage control signals used to dynamically adjust the operation voltage of the source driving unit.

24. The source driver of claim 23, wherein the source driver further comprises a substrate leakage current monitoring unit coupled to the source driving unit to monitor a substrate leakage-current.

25. A panel display apparatus, comprising:

a source driving circuit, driving a display array unit; and a voltage and speed regulation structure of claim 14, being coupled with the source driving circuit, to control the source driving circuit through dynamically regulating an operation voltage and an operation speed.

* * * * *